US012442590B2

(12) United States Patent
Bet et al.

(10) Patent No.: US 12,442,590 B2
(45) Date of Patent: Oct. 14, 2025

(54) REFRIGERATION APPLIANCE WITH A REFRIGERANT LINE AND WATER LINE EXTENDING THROUGH COMMON PASS-THROUGH OF A VACUUM-INSULATED STRUCTURE

(71) Applicant: WHIRLPOOL CORPORATION, Benton Harbor, MI (US)

(72) Inventors: Kapil Devidas Bet, Solapur (IN); Vishal Brahmanand Chauhan, Maharashtra (IN); Rahul Subhash Chhajed, Stevensville, MI (US); Anup Bapu More, Maharashtra (IN); Abinash Sarma, Assam (IN)

(73) Assignee: Whirlpool Corporation, Benton Harbor, MI (US)

( * ) Notice: Subject to any disclaimer, the term of this patent is extended or adjusted under 35 U.S.C. 154(b) by 209 days.

(21) Appl. No.: 18/207,362

(22) Filed: Jun. 8, 2023

(65) Prior Publication Data

US 2024/0410643 A1 Dec. 12, 2024

(51) Int. Cl.
*F25D 23/06* (2006.01)

(52) U.S. Cl.
CPC ..... *F25D 23/061* (2013.01); *F25D 2201/14* (2013.01)

(58) Field of Classification Search
CPC .. F25D 23/061; F25D 2201/14; F25D 23/068; F25D 2321/146; F25D 2201/10–1262; F25D 17/067; F25C 2400/14
See application file for complete search history.

(56) References Cited

U.S. PATENT DOCUMENTS

| | | | |
|---|---|---|---|
| 9,752,818 B2 | 9/2017 | Naik | |
| 11,175,089 B2 | 11/2021 | Marinello et al. | |
| 11,313,613 B2 | 4/2022 | Jung et al. | |

FOREIGN PATENT DOCUMENTS

| | | | | |
|---|---|---|---|---|
| DE | 102016000372 A1 * | 3/2017 | ..... | F25D 21/14 |
| EP | 1887154 A2 | 2/2008 | | |
| EP | 3447413 B1 | 4/2020 | | |
| JP | 06194032 A | 7/1994 | | |
| JP | 5990731 B2 | 8/2016 | | |
| WO | 200877763 A1 | 7/2008 | | |

OTHER PUBLICATIONS

English language translation of DE102016000372 to Hose et al. Translated Feb. 2025 (Year: 2017).*

* cited by examiner

*Primary Examiner* — Cassey D Bauer
(74) *Attorney, Agent, or Firm* — Price Heneveld LLP

(57) ABSTRACT

A refrigeration appliance includes a vacuum-insulated structure that defines an interior compartment. The vacuum-insulated structure defines a pass-through through the vacuum-insulated structure. The pass-through provides access from an external environment to the interior compartment. An evaporator is disposed within the interior compartment. The evaporator is operable to lower or maintain a temperature of the interior compartment below ambient temperature. A refrigerant line extends through the pass-through and into the interior compartment. A water line extends through the pass-through and into the interior compartment. An insulation block is disposed within the interior compartment and between the evaporator and the water line.

17 Claims, 12 Drawing Sheets

REFRIGERATION APPLIANCE WITH A REFRIGERANT LINE AND WATER LINE EXTENDING THROUGH COMMON PASS-THROUGH OF A VACUUM-INSULATED STRUCTURE

BACKGROUND OF THE DISCLOSURE

The present disclosure generally relates to a refrigeration appliance, and more specifically, to a refrigeration appliance that includes an insulation block, a refrigerant line, and a water line extending through a common pass-through of a vacuum-insulated structure.

Some refrigerators incorporate a vacuum-insulated cabinet. The vacuum-insulated cabinet may separate a refrigeration compartment from a freezer compartment. It is often desirable to offer ice and water dispensing capability within the refrigeration compartment and ice-making capability within the freezer compartment. In some refrigerators, one or more pass-throughs through the vacuum-insulated cabinet are required to transport water to either a water dispenser or an ice-maker. However, in such refrigerators, multiple pass-throughs can make it difficult to maintain a vacuum within the vacuum-insulated cabinet and a single pass-through may cause unwanted freezing in a water line.

SUMMARY OF THE DISCLOSURE

According to one aspect of the present disclosure, a refrigeration appliance includes a vacuum-insulated structure that defines an interior compartment. The vacuum-insulated structure defines a pass-through through the vacuum-insulated structure that provides access from an external environment to the interior compartment. An evaporator is disposed within the interior compartment. The evaporator is operable to lower or maintain a temperature of the interior compartment below ambient temperature. A pass-through grommet is disposed within the pass-through. The pass-through grommet defines a first aperture and a second aperture. A refrigerant line extends through the first aperture and into the interior compartment. The refrigerant line is in fluid communication with the evaporator. A water line extends through the second aperture and into the interior compartment. An insulation block is disposed within the interior compartment. The insulation block is disposed between the evaporator and the water line. A pass-through cover is disposed over the pass-through and is coupled to the vacuum-insulated structure.

According to another aspect of the present disclosure, a vacuum-insulated structure defines an interior compartment. The vacuum-insulated structure defines a pass-through extending through the vacuum-insulated structure and providing access from an external environment to the interior compartment. An evaporator is disposed within the interior compartment. The evaporator is operable to lower or maintain a temperature of the interior compartment below ambient temperature. A refrigerant line extends through the pass-through and into the interior compartment. The refrigerant line is in fluid communication with the evaporator. A water line extends through the pass-through and into the interior compartment. An insulation block is disposed within the interior compartment and between the evaporator and water line. The insulation block at least partially encircles the water line.

According to another aspect of the present disclosure, a refrigeration appliance includes a vacuum-insulated structure that defines an interior compartment. The vacuum-insulated structure defines a pass-through through the vacuum-insulated structure. The pass-through provides access from an external environment to the interior compartment. An evaporator is disposed within the interior compartment. The evaporator is operable to lower or maintain a temperature of the interior compartment below ambient temperature. A refrigerant line extends through the pass-through and into the interior compartment. A water line extends through the pass-through and into the interior compartment. An insulation block is disposed within the interior compartment and between the evaporator and the water line.

These and other features, advantages, and objects of the present disclosure will be further understood and appreciated by those skilled in the art by reference to the following specification, claims, and appended drawings.

Figure 1:
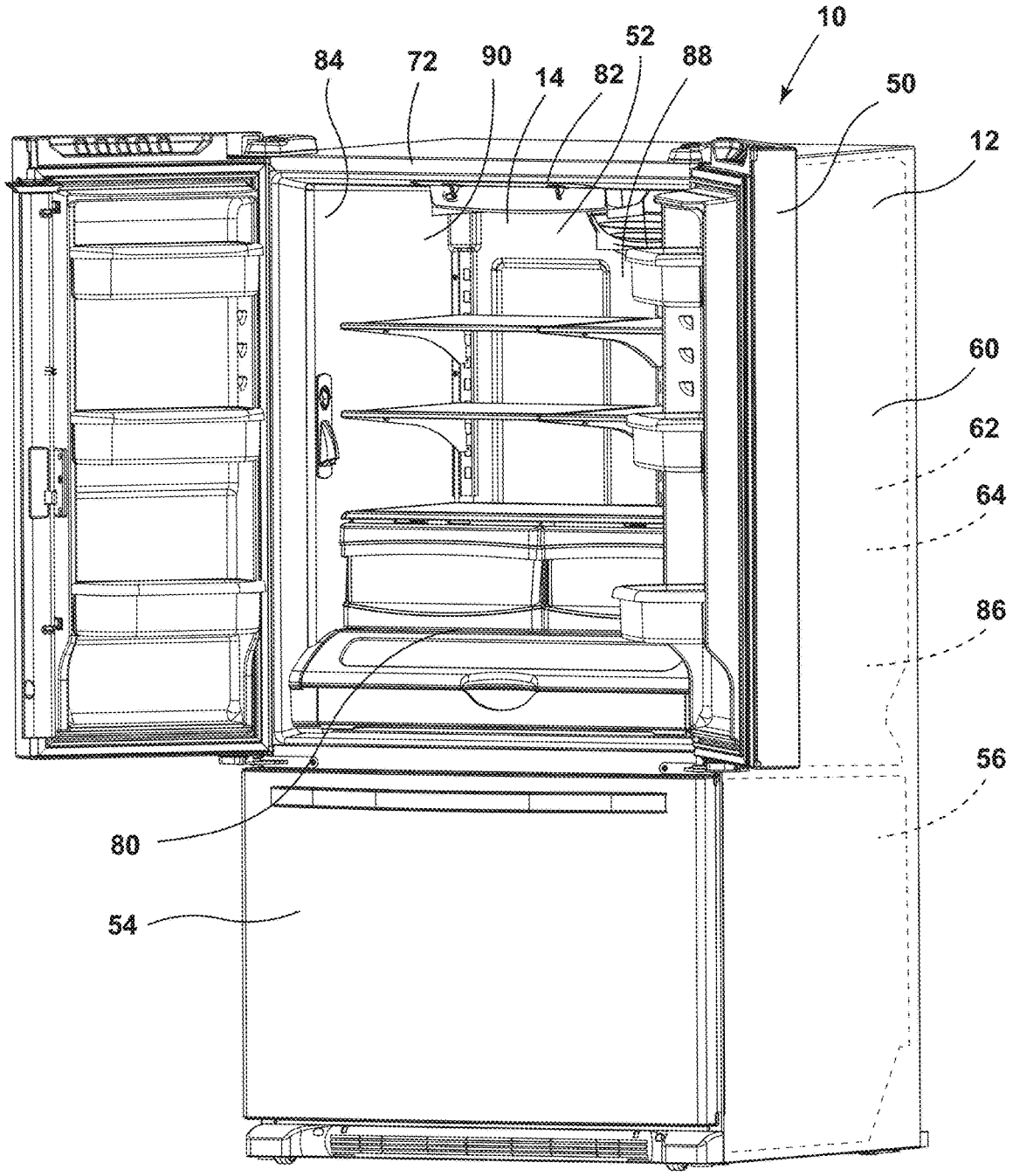
FIG. 1 is a front perspective view of a refrigeration appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum-insulated appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13, reference numeral 10 generally designates a refrigeration appliance 10. The refrigeration appliance 10 includes a vacuum-insulated structure 12 that defines an interior compartment 14. The vacuum-insulated structure 12 defines a pass-through 16 providing access from an external environment 18 to the interior compartment 14. An evaporator 20 is disposed within the interior compartment 14. The evaporator 20 is operable to lower or maintain a temperature of the interior compartment 14 below ambient temperature. A pass-through grommet 22 is disposed within the pass-through 16. The pass-through grommet 22 defines a first aperture 24 and a second aperture 26. A refrigerant line 28 extends through the first aperture 24 and into the interior compartment 14 and is in fluid communication with the evaporator 20. A water line 30 extends through the second aperture 26 and into the interior compartment 14. An insulation block 32 is disposed within the interior compartment 14. An insulation block 32 is disposed between the evaporator 20 and the water line 30. A pass-through cover 34 is disposed over the pass-through 16 and is coupled to the vacuum-insulated structure 12.

Figure 2:
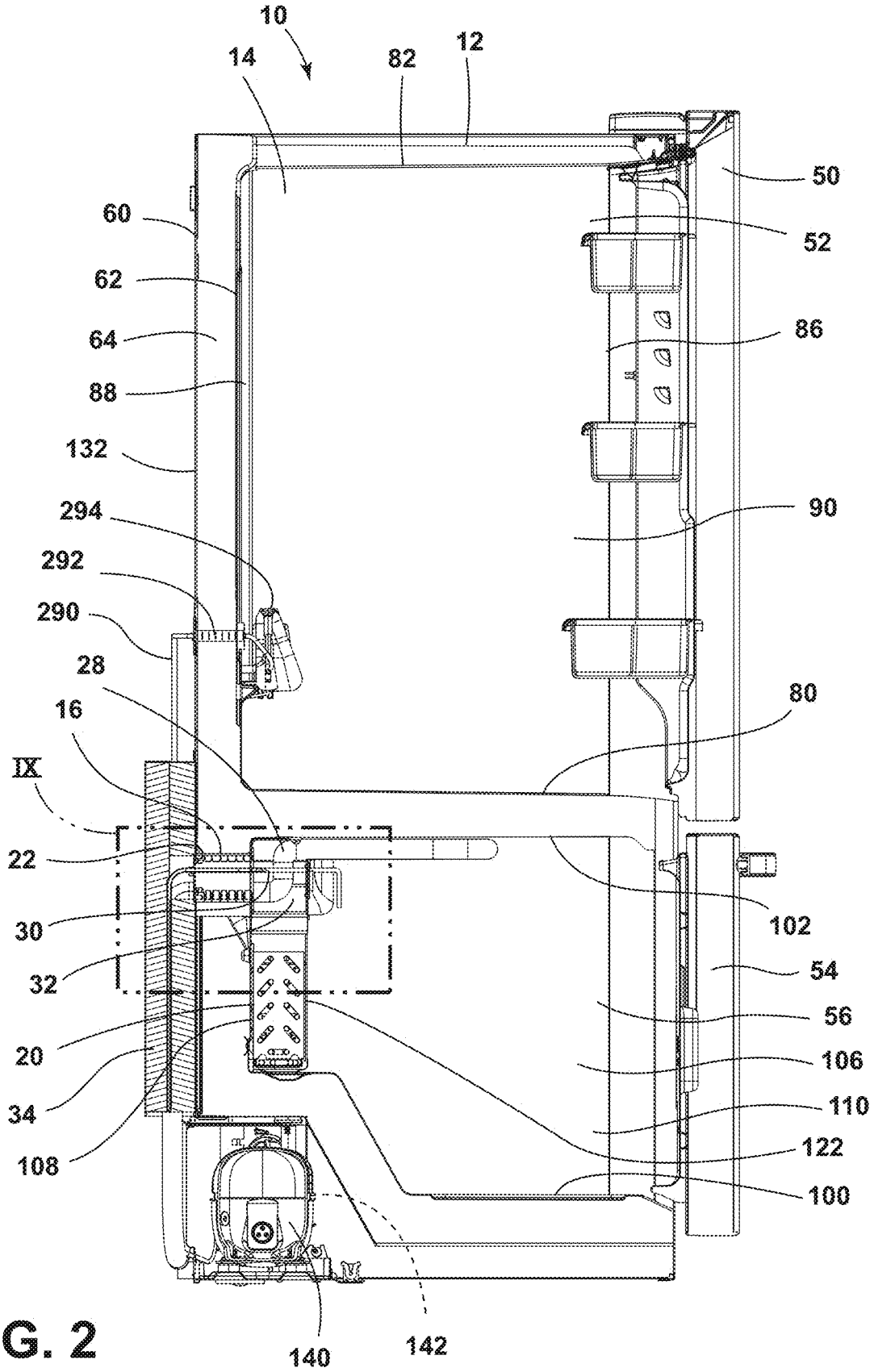
FIG. 2 is a cross-sectional, side elevational view of a refrigeration appliance, according to the present disclosure.
Figure 3:
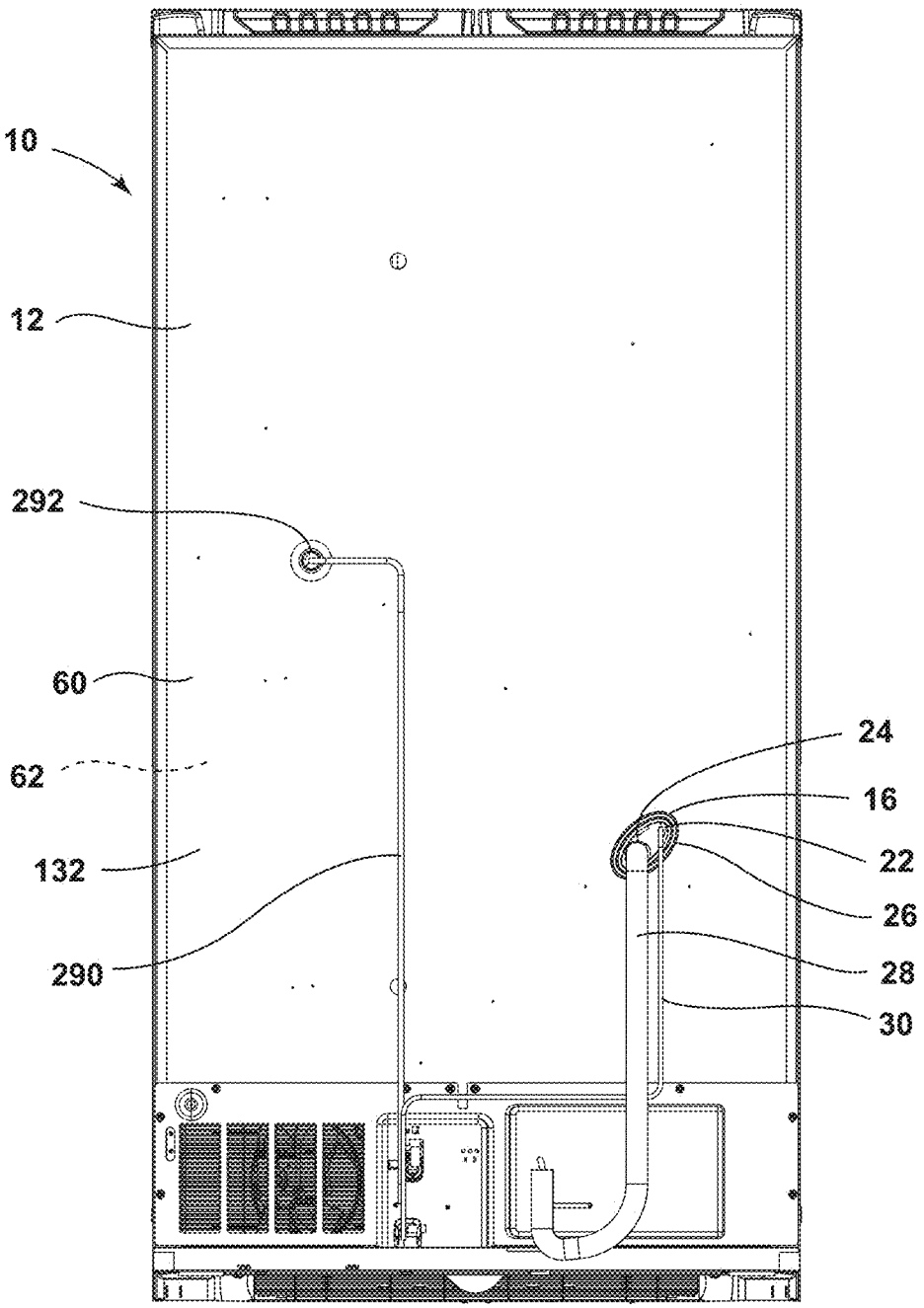
FIG. 3 is a rear elevational view of a refrigeration appliance, according to the present disclosure.
Figure 4:
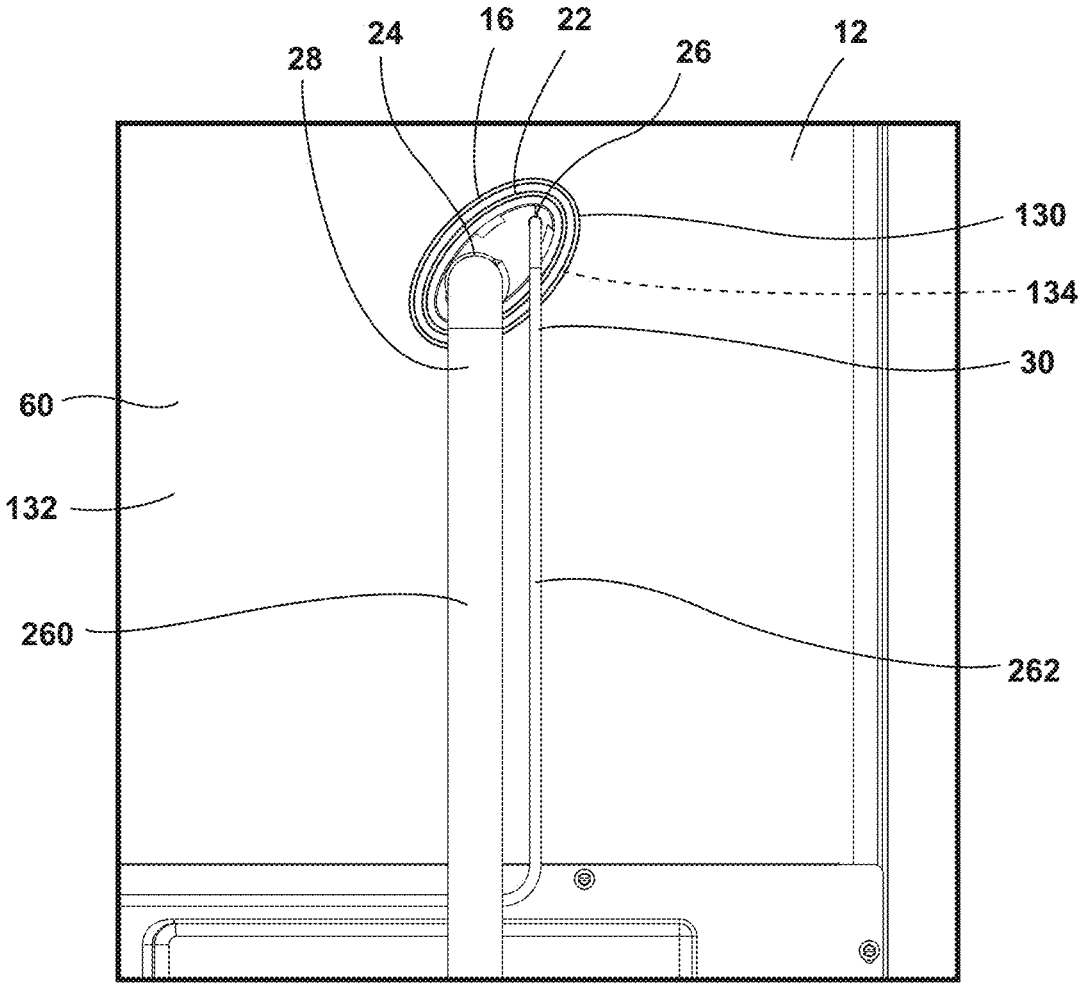
FIG. 4 is an enlarged rear elevational view of a refrigeration appliance with a pass through and a refrigerant line and a water line extending through the pass-through, according to the present disclosure.
Figure 5:
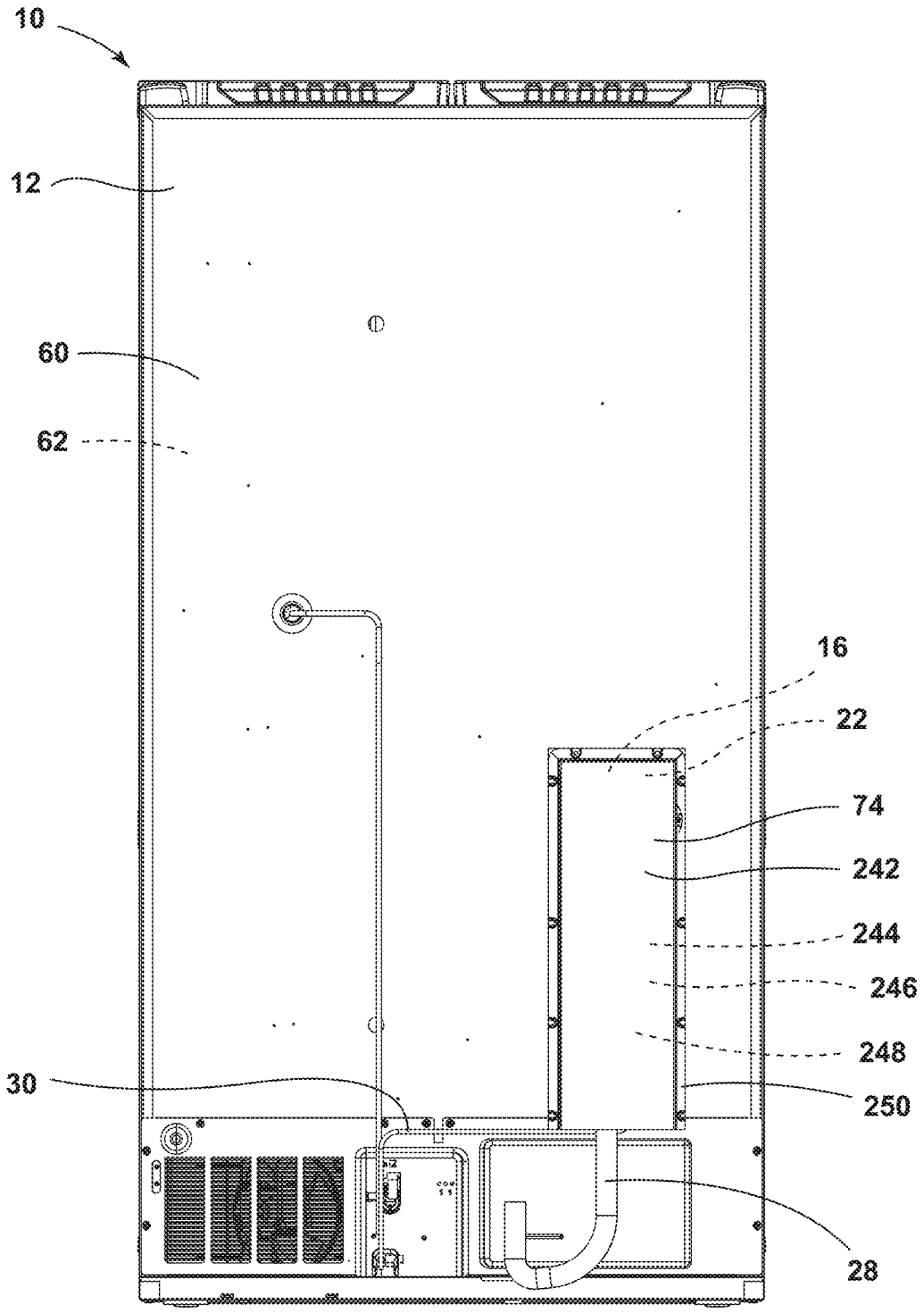
FIG. 5 is a rear elevational view of a refrigeration appliance with a pass-through cover, according to the present disclosure.
Figure 6:
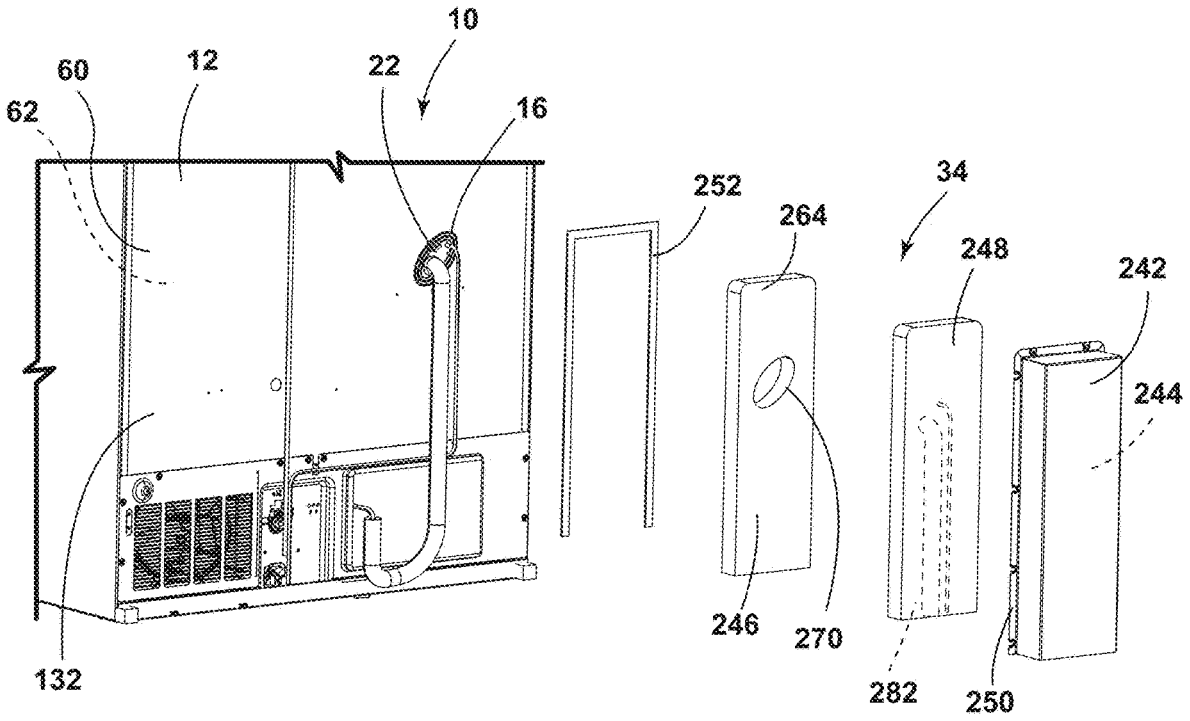
FIG. 6 is a partially exploded, rear perspective view of a refrigeration appliance with a pass-through and a pass-through cover, according to the present disclosure.
Figure 7:
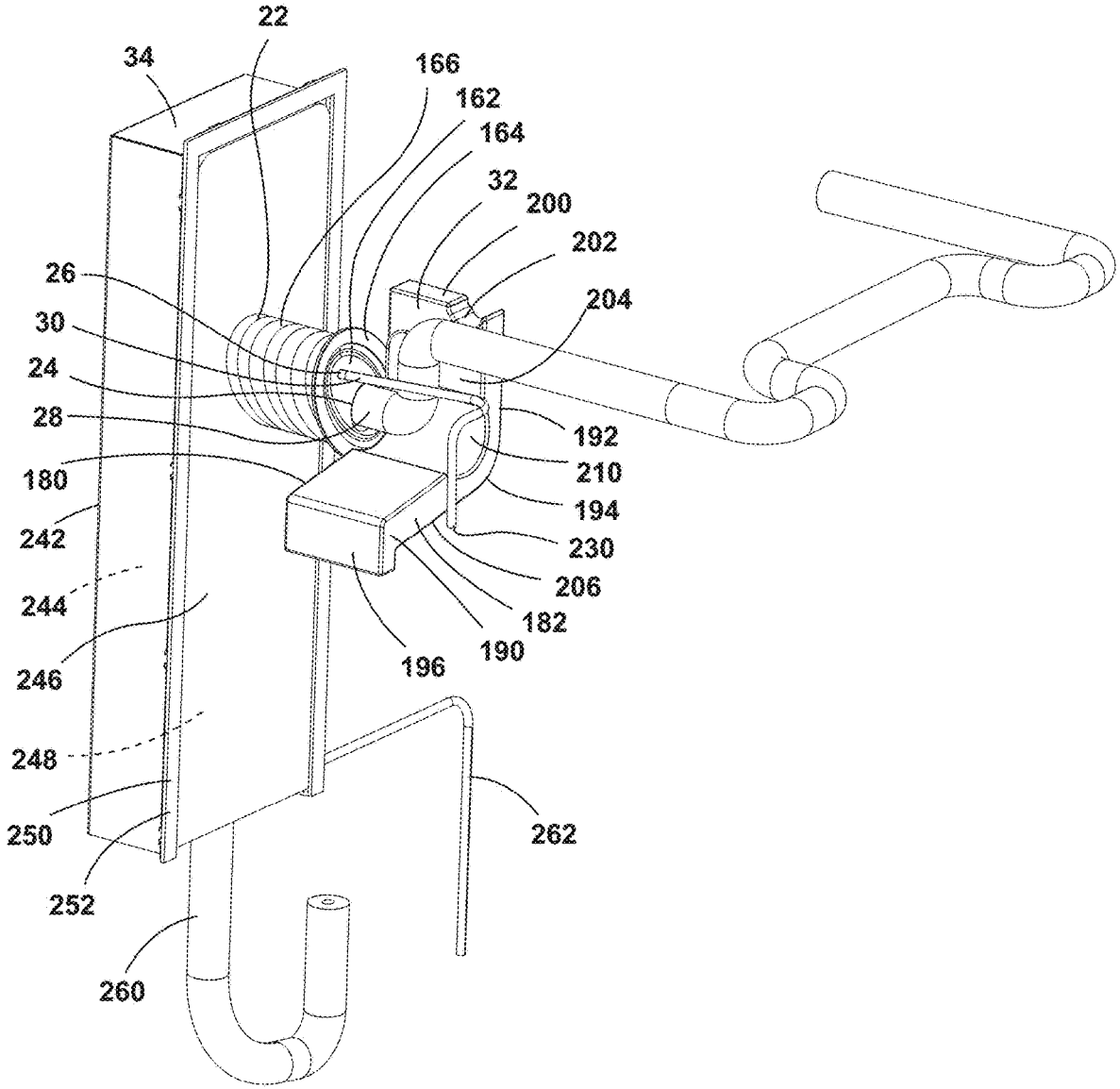
FIG. 7 is a first side rear perspective view of a pass-through grommet with a refrigerant line and a water line extending through the pass-through grommet, and a pass-through cover and an insulation block, according to the present disclosure.
Figure 8:
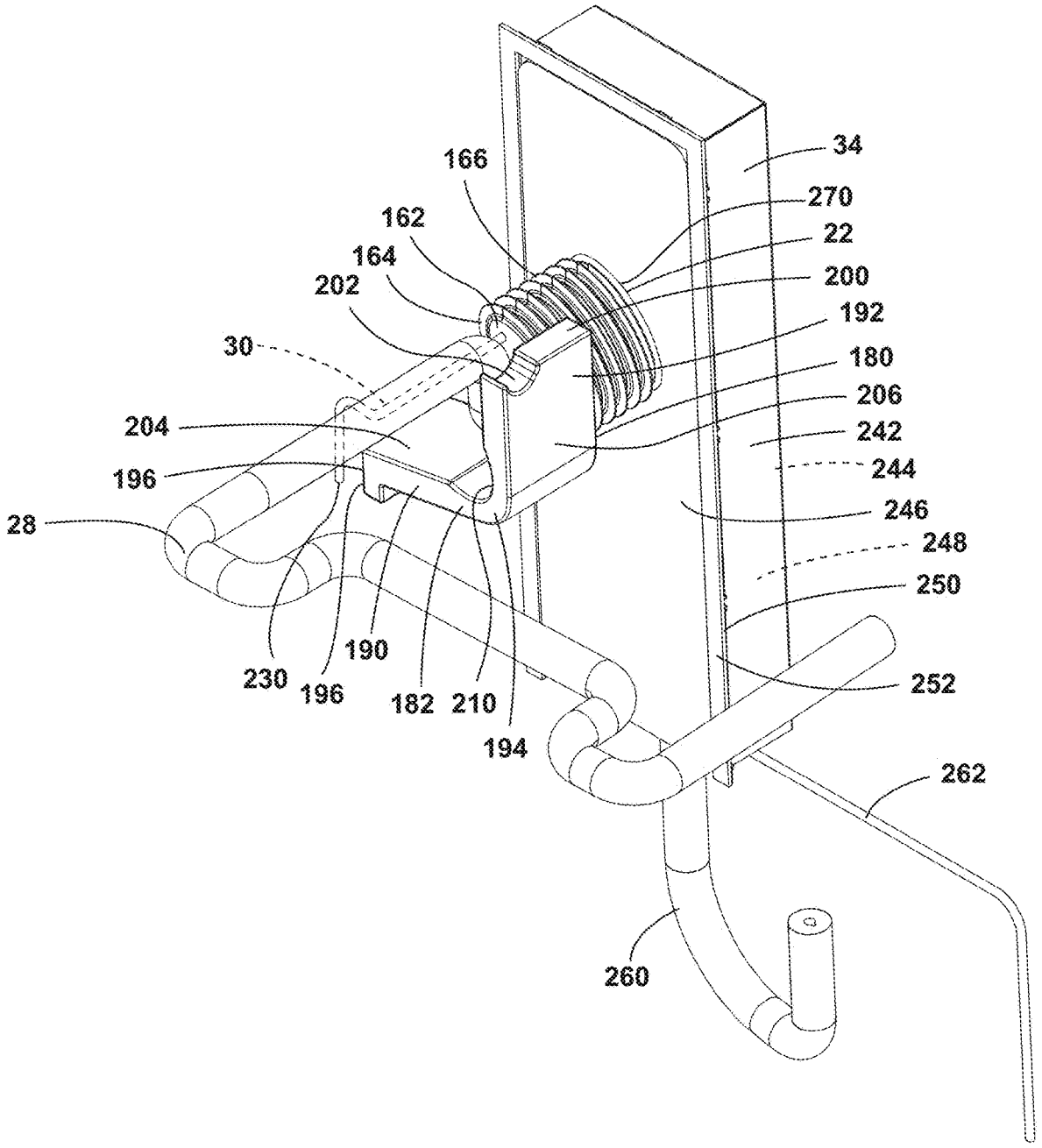
FIG. 8 is a second side rear perspective view of a pass-through grommet with a refrigerant line and a water line extending through the pass-through grommet, and a pass-through cover and an insulation block, according to the present disclosure.

Referring to FIGS. 1 and 2, the refrigeration appliance 10 is illustrated as a refrigerator appliance with one or more doors 50 that operably provide access to a refrigerator compartment 52 and a lower pull-out drawer 54 that provides access to a freezer compartment 56. However, it is contemplated that the vacuum-insulated structure 12 may be used with a variety of appliances, structures, or refrigeration purposes other than with an appliance. Moreover, the illustrated appliance 10 is a bottom-mount French door refrigerator. In non-limiting examples, the refrigeration appliance 10 can be a bottom-mount refrigerator, or a five-door French door refrigerator.

With reference still to FIGS. 1 and 2, the vacuum-insulated structure 12 includes a wrapper 60, a liner 62 coupled to the wrapper 60, and a vacuum-insulated cavity 64 defined between the wrapper 60 and the liner 62. The vacuum-insulated cavity 64 has a pressure that is less than an ambient pressure of an external environment 18. The reduced pressure within the vacuum-insulated cavity 64 is such that heat transfer between the external environment 18 and the refrigerator compartment 52 or the freezer compartment 56 is reduced.

To maintain the reduced pressure within the vacuum-insulated cavity 64, the refrigerant line 28 and the water line 30 may both be routed through the pass-through 16, which extends through the vacuum-insulated cavity 64, and into the freezer compartment 56. However, in aspects where the refrigerant line 28 and the water line 30 are routed through the pass-through 16 and into the freezer compartment 56, it can be difficult to maintain a liquid state of water within the water line 30, as the close proximity of the refrigerant line 28 to the water line 30 and the routing of the water line 30 into the freezer compartment 56 may cause thermal energy to transfer from the water line 30 and cause the water within the water line 30 to freeze.

To keep the water in the water line 30 in a liquid state, the refrigeration appliance 10 disclosed herein may incorporate optimal spacing between the refrigerant line 28 and the water line 30, a heater 70, and an insulation feature, such as the insulation block 32 disposed between the water line 30 and the evaporator 20, to ensure that water within the water line 30 is maintained in a liquid state.

Referring again to FIGS. 1 and 2, the vacuum-insulated structure 12 includes the wrapper 60, the liner 62 coupled to the wrapper 60, and a trim breaker 72 coupled to the wrapper 60 and the liner 62. The wrapper 60 generally faces the liner 62 and at least partially encompasses the liner 62. The vacuum-insulated cavity 64 is defined in the space between the wrapper 60 and the liner 62, and the trim breaker 72 seals the vacuum-insulated cavity 64. The vacuum-insulated cavity 64 has a pressure that is less than an ambient pressure of the external environment 18. The vacuum-insulated cavity 64 may contain various insulation materials, such as an insulation powder, fiberglass, and various other suitable insulative materials. According to various aspects, the reduced pressure within the vacuum-insulated cavity 64 relative to the external environment 18 is such that a rate of heat transfer between the external environment 18 and the interior compartment 14 is reduced.

Referring to FIG. 1, the vacuum-insulated structure 12 defines the interior compartment 14. In some examples, the vacuum-insulated structure 12 may define multiple interior compartments 14, such as the refrigerator compartment 52 and the freezer compartment 56. In use, the refrigerator compartment 52 and the freezer compartment 56 are maintained at different temperatures. For example, the refrigerator compartment 52 can be configured to maintain a temperature above 0° C. but below ambient temperature of the external environment 18, such as a within a range from greater than 0° C. to 8° C. The refrigerator compartment 52 is used to maintain a food item disposed therein at a cold but not freezing temperature to prolong the usable life of the food item. The freezer compartment 56 can be configured to maintain a temperature that is less than or equal to 0° C. The freezer compartment 56 is used to maintain the food item disposed therein in a frozen state to prolong the usable life of the food item. The refrigerator compartment 52 can be disposed above the freezer compartment 56, as in the illustrated example of FIG. 1, although other configurations are generally contemplated.

Referring further to FIG. 1, the refrigerator compartment 52 includes a floor 80, a ceiling 82 opposing the floor 80, a first sidewall 84, a second sidewall 86 opposing the first sidewall 84, and a rear wall 88. The refrigerator compartment 52 also defines an opening 90 that opposes the rear wall 88 and operably provides access to the refrigerator compartment 52. As illustrated in FIG. 1, the opening 90 is operably sealed from the external environment 18 via the doors 50, which are pivotable between an open position and a closed position. According to various aspects, the liner 62 of the vacuum-insulated structure 12 provides the floor 80, ceiling 82, first sidewall 84, second sidewall 86, and the rear wall 88 of the refrigerator compartment 52.

The freezer compartment 56 likewise includes a floor 100, a ceiling 102 opposing the floor 100, a first sidewall 104, a second sidewall 106 opposing the first sidewall 104, and a rear wall 108. The freezer compartment 56 also defines an opening 110 that opposes the rear wall 108 and operably provides access to the freezer compartment 56. As illustrated in FIGS. 1 and 2, the opening 110 to the freezer compartment 56 is operably sealed from the external environment 18 via the pull-out drawer 54, which is movable between an open position and a closed position. According to various aspects, the liner 62 of the vacuum-insulated structure 12 provides the floor 100, ceiling 102, first sidewall 104, second sidewall 106, and the rear wall 108 of the freezer compartment 56.

The refrigeration appliance 10 includes the evaporator 20. The evaporator 20 is disposed within the freezer compartment 56. The evaporator 20 is disposed inside of the liner 62 of the vacuum-insulated structure 12. In various aspects, the evaporator 20 is disposed adjacent the rear wall 108 and floor 100 of the freezer compartment 56. In some examples, the evaporator 20 may be disposed proximate an ice-maker 120 that is disposed in the freezer compartment 56, or the evaporator 20 may be disposed behind a cover panel 122, such that the evaporator 20 is hidden when viewing the freezer compartment 56 through the opening 110.

According to various aspects, the cover panel 122 may be disposed in the freezer compartment 56. In some examples, the cover panel 122 extends from the first sidewall 104 to the second sidewall 106 of the freezer compartment 56 and/or from the floor 100 to the ceiling 102 of the freezer compartment 56. In such examples, the cover panel 122 is disposed forward of the evaporator 20 such that the evaporator 20 is hidden when viewing the freezer compartment 56 from the opening 110.

The evaporator 20 withdraws heat from the interior compartment 14 in order to maintain the temperature of the interior compartment 14 below ambient temperature. In the illustrated example of FIG. 2 where the evaporator 20 is disposed within the freezer compartment 56, the evaporator 20 withdraws heat from the freezer compartment 56 to maintain the temperature within the freezer compartment 56 at a desired temperature, such as a temperature that is less than or equal to 0° C.

Referring now to FIGS. 3-6 and 9-10, the vacuum-insulated structure 12 includes the pass-through 16. The pass-through 16 is defined by a wrapper aperture 130, which may be defined on a rear panel 132 of the wrapper 60, and a liner aperture 134 that is defined on the liner 62 and generally aligns with the wrapper aperture 130. In some examples, the wrapper aperture 130 and the liner aperture 134 are positioned on the wrapper 60 and liner 62, respectively, such that passage is permitted between the external environment 18 and the freezer compartment 56. According to various aspects, the alignment of the wrapper aperture 130 and the liner aperture 134 is such that various components are permitted to extend through the pass-through 16 from the external environment 18 and into the freezer compartment 56, as provided herein.

The refrigeration appliance 10 includes the refrigerant line 28. The refrigerant line 28 extends from the external environment 18, through the pass-through 16, and into the freezer compartment 56. In some examples, the refrigerant line 28 extends into the freezer compartment 56 and along the ceiling 102 of the freezer compartment 56. In such examples the extension of the refrigerant line 28 along the ceiling 102 may be such that a minimum length of a heat exchanger may be maintained. For example, the refrigerant line 28 may extend into the freezer compartment 56 and proximate the ceiling 102 such that the evaporator 20 disposed in the freezer compartment 56 is permitted to occupy an increased space below the section of the refrigerant line 28 that extends into the freezer compartment 56.

According to various aspects, the refrigerant line 28 is in fluid communication with the evaporator 20. In use, the refrigerant line 28 carries refrigerant to and from the evaporator 20. While in the evaporator 20, the refrigerant absorbs heat from the freezer compartment 56 and evaporates into a gas. The refrigerant then proceeds through the refrigerant line 28 from the evaporator 20 and towards a compressor 140. The compressor 140 raises the temperature and pressure of the refrigerant. The refrigerant then passes through a condenser 142. At the condenser 142, the refrigerant cools and condenses back into a liquid. The refrigerant, now cooled and in a liquid state, is then moved again to the evaporator 20 via the refrigerant line 28 to perform the refrigeration cycle again. According to various aspects, the refrigerant line 28 is formed of a metal, such as copper or aluminum.

The refrigeration appliance 10 further includes the water line 30. The water line 30 extends from the external environment 18, through the pass-through 16 with the refrigerant line 28, and into the freezer compartment 56. The refrigerant line 28 and the water line 30 are relatively spaced apart through the pass-through 16. For example, the refrigerant line 28 and the water line 30 may be spaced apart by at least 18.3 millimeters (mm). By spacing the refrigerant line 28 and the water line 30 apart, the ability of the refrigerant line 28 to withdraw heat from water in the water line 30 and cause the water to solidify into ice is reduced. In some examples, the water line 30 may extend through the pass-through 16 and continue to extend towards the opening 110 of the freezer compartment 56 until the water line 30 extends beyond the insulation block 32. The water line 30 may then extend towards a component of the refrigeration appliance 10, such as the ice-maker 120. In use, the water line 30 carries water from a source in the external environment 18, through the pass-through 16, and into the freezer compartment 56. The water can then be utilized for a variety of purposes, such as by the ice-maker 120, as provided herein. The water within the water line 30 generally has a temperature above 0° C. Additionally, it is generally contemplated that a diameter of the water line 30 at various sections of the water line 30 may have a consistent diameter or a varying diameter. For example, the diameter of the water line 30 external to the freezer compartment 56 may be less than the diameter of the water line 30 inside the freezer compartment 56.

According to various aspects of this disclosure, the refrigeration appliance 10 includes the heater 70 disposed proximate the water line 30. In some examples, the heater 70 is disposed proximate the water line 30 near where the water line 30 enters the freezer compartment 56 from the pass-through 16. For example, the heater 70 can be disposed at a distance of about 5 centimeters (cm) or less from the water line 30 entering the freezer compartment 56 from the pass-through 16. In various aspects, the heater 70 may extend around at least a portion of an outer periphery of the water line 30. In further aspects, the heater 70 may be proximate or coupled to the water line 30 and be disposed inward of the insulation block 32. According to various aspects, the heater 70 is positioned relative to the water line 30 to impart sufficient heat to the water within the water line 30 to prevent the water from freezing or to thaw water that has frozen. Additionally, or alternatively, it is generally contemplated that the heater 70 can be one of various kinds of heaters, such as a resistive heater, a thermoelectric heater, or various other kinds of heaters, without departing from the teachings herein.

Referring to FIGS. 3-10, the refrigeration appliance 10 includes the pass-through grommet 22 disposed within the pass-through 16. In some examples, the pass-through grommet 22 may be disposed in the pass-through 16 such that a rear portion 160 of the pass-through grommet 22 is recessed, flush, or protruding from the wrapper 60 of the vacuum-insulated structure 12 and a front portion 162 of the pass-through grommet 22 is recessed, flush, or protruding from the liner 62. In such examples, the pass-through grommet 22 may include a rim 164 that protrudes outward from the rear portion 160 and/or the front portion 162 and extends beyond an outer periphery of the pass-through 16. In various aspects, the pass-through grommet 22 may include ribs 166 that are disposed between the rear portion 160 and the front portion 162.

According to various aspects, the pass-through grommet 22 can help maintain an air-tight seal within the vacuum-insulated structure 12 about the pass-through 16. The air-tight seal may be at least partially maintained by engagement between the ribs 166 and/or the extension of the rim 164 beyond the pass-through 16. Additionally, or alternatively, it is generally contemplated that the pass-through grommet 22 can have a rubber or elastomeric composition and be slightly oversized relative to the wrapper aperture 130 and the liner aperture 134 that form the pass-through 16 through the vacuum-insulated structure 12 to assist in maintaining the air-tight seal. For example, the ribs 166 may be formed from an elastomer material and be slightly oversized relative to the pass-through 16 such that each rib 166 abuts an inner sidewall 168 of the pass-through 16.

The refrigerant line 28 and the water line 30 extend through the pass-through grommet 22. The pass-through grommet 22 forms an air-tight seal around the refrigerant line 28 and the water line 30. For example, the pass-through grommet 22 may include the first aperture 24, through which the refrigerant line 28 extends, and the second aperture 26, through which the water line 30 extends. The first aperture 24 and the second aperture 26 may be sized slightly smaller than the outer diameters of the refrigerant line 28 and the water line 30 respectively. According to various aspects, the air-tight fitting of the pass-through grommet 22 around the refrigerant line 28 and the water line 30 helps limit heat transfer between the external environment 18 and the freezer compartment 56 through the first aperture 24 and the second aperture 26.

Referring to FIGS. 7-12, the refrigeration appliance 10 includes an insulation feature, such as the insulation block 32. The insulation block 32 is disposed within the freezer compartment 56 and between the water line 30 and the evaporator 20. In various aspects, the insulation block 32 is disposed proximate the pass-through 16 such that a rear surface 180 of the insulation block 32 is proximate the pass-through 16 and/or abuts the front portion 162 of the pass-through grommet 22 and a front surface 182 abuts the cover panel 122. In some examples, the pass-through grommet 22 has a depth that extends from the front portion 162 of the pass-through grommet 22 and towards the opening 110 of the freezer compartment 56. According to various aspects, the depth of the insulation block 32 may coincide with various variables, such as volume of the freezer compartment 56, routing of the water line 30, placement of the evaporator 20, and/or various other factors.

As illustrated in FIGS. 7-12, the insulation block 32 includes a first portion 190 and a second portion 192 that intersect at an insulation block corner 194. The first portion 190 may be obliquely orientated relative to the second portion 192 and is disposed above the evaporator 20. The first portion 190 extends towards the first sidewall 104 of the freezer compartment 56 and includes an abutment section 196 that may abut and/or couple to the first sidewall 104 and/or the second sidewall 106 of the freezer compartment 56. According to various aspects, the abutment section 196 can be coupled to the first sidewall 104 and/or the second sidewall 106 via adhesion, bonding, one or more fasteners, and/or insertion of the abutment section 196 into a receiver. In some examples, the abutment section 196 may be vertically elongated and extend along the first sidewall 104 and/or the second sidewall 106 such that an amount of engagement between the abutment section 196 and the first sidewall 104 is increased.

The second portion 192 of the insulation block 32 extends upward from the insulation block corner 194. According to various aspects, the second portion 192 extends towards the ceiling 102 of the freezer compartment 56. In some examples, the second portion 192 includes a top surface 200 at an end of the second portion 192. The top surface 200 of the second portion 192 abuts and/or couples to the ceiling 102 of the freezer compartment 56. The top surface 200 can be coupled to the ceiling 102 via adhesion, bonding, and/or one or more fasteners that engage with the ceiling 102.

In various aspects, the top surface 200 may define a top channel 202 that extends from an interior surface 204 of the insulation block 32 to an exterior surface 206 of the insulation block 32. The top channel 202 may define a circular shape, a quadrilateral shape, and/or other various shapes. According to various examples, the top channel 202 permits extension of conduit through the insulation block 32. In such examples, the shape of the top channel 202 may coincide with the shape of the conduit. For example, the top channel 202 may have a circular shape with a width that corresponds to a circular shape and width of conduit extending through the top channel 202. Additionally, it is generally contemplated that a depth of the top channel 202 coincides with a depth of the conduit such that the conduit may extend through the top channel 202 while the top surface 200 is abutting the ceiling 102 of the freezer compartment 56.

According to various aspects, the first portion 190 and the second portion 192 may be comprised of an insulating material. For example, the first portion 190 and the second portion 192 may be comprised of various insulating foams, such as expanded polystyrene, expanded polyurethane, or various other kinds of insulating foam.

Referring to FIGS. 7-9 and 11-12, an insulation block channel 210 is defined on the interior surface 204 of the insulation block 32 at the insulation block corner 194. The insulation block channel 210 extends from the rear surface 180 of the insulation block 32 to the front surface 182 of the insulation block 32. In some examples, the insulation block channel 210 defines a substantially semi-circular shape that is recessed towards the exterior surface 206 and is at least partially defined on the first portion 190 and/or the second portion 192. In such examples, the semi-circular shape of the insulation block channel 210 may coincide with the circular shape of the pass-through 16. According to various aspects, the insulation block channel 210 permits the extension of the refrigerant line 28 and the water line 30 from the pass-through 16 and into the freezer compartment 56. In such aspects, the circular shape of the insulation block channel 210 further provides increased insulation of the refrigerant line 28 and the water line 30, as the semi-circular shape of the insulation block channel 210 provides for a partial envelopment of the refrigerant line 28 and the water line 30.

Figure 9:
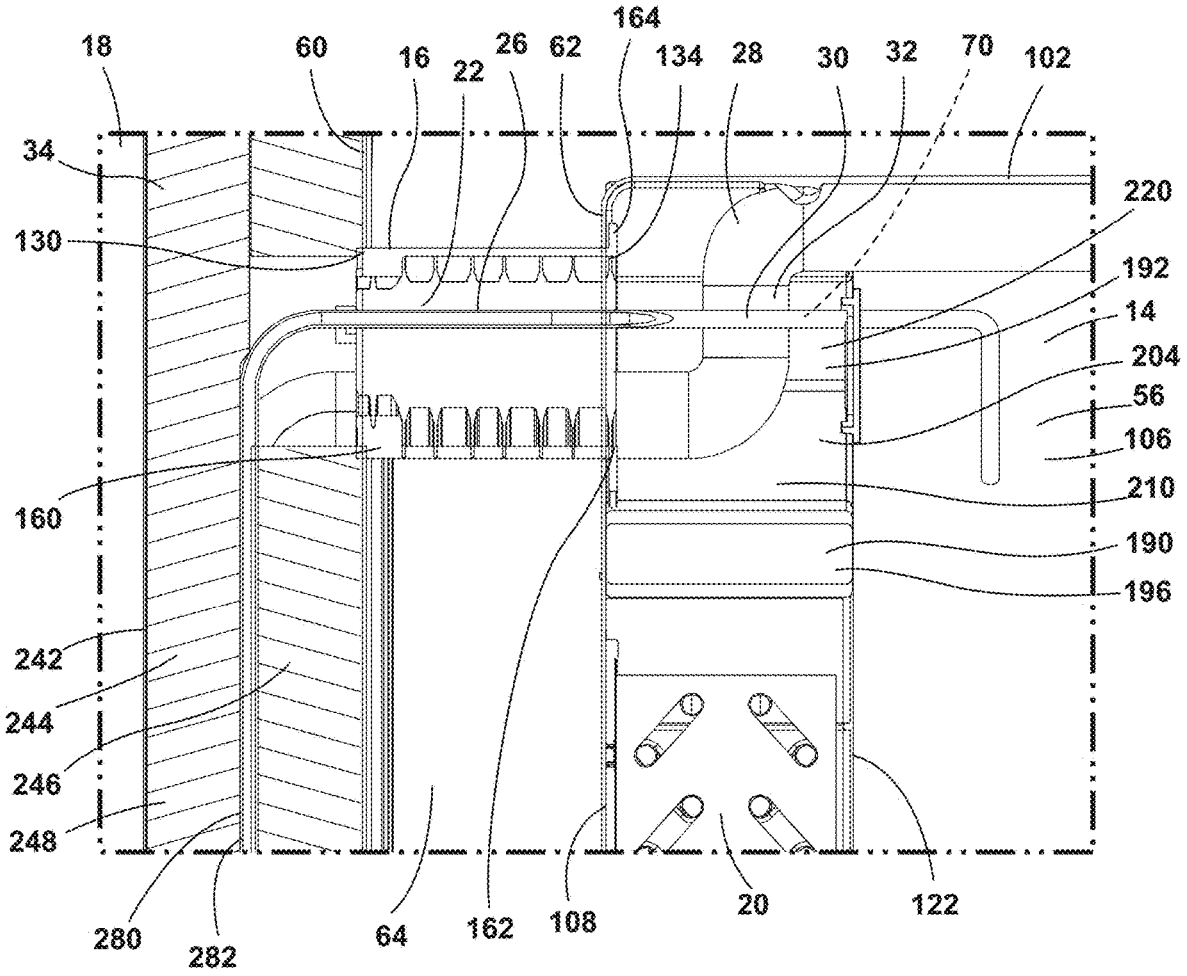
FIG. 9 is a cross-sectional, side elevational view of a freezer compartment of the freezer appliance of FIG. 2, according to the present disclosure.
Figure 10:
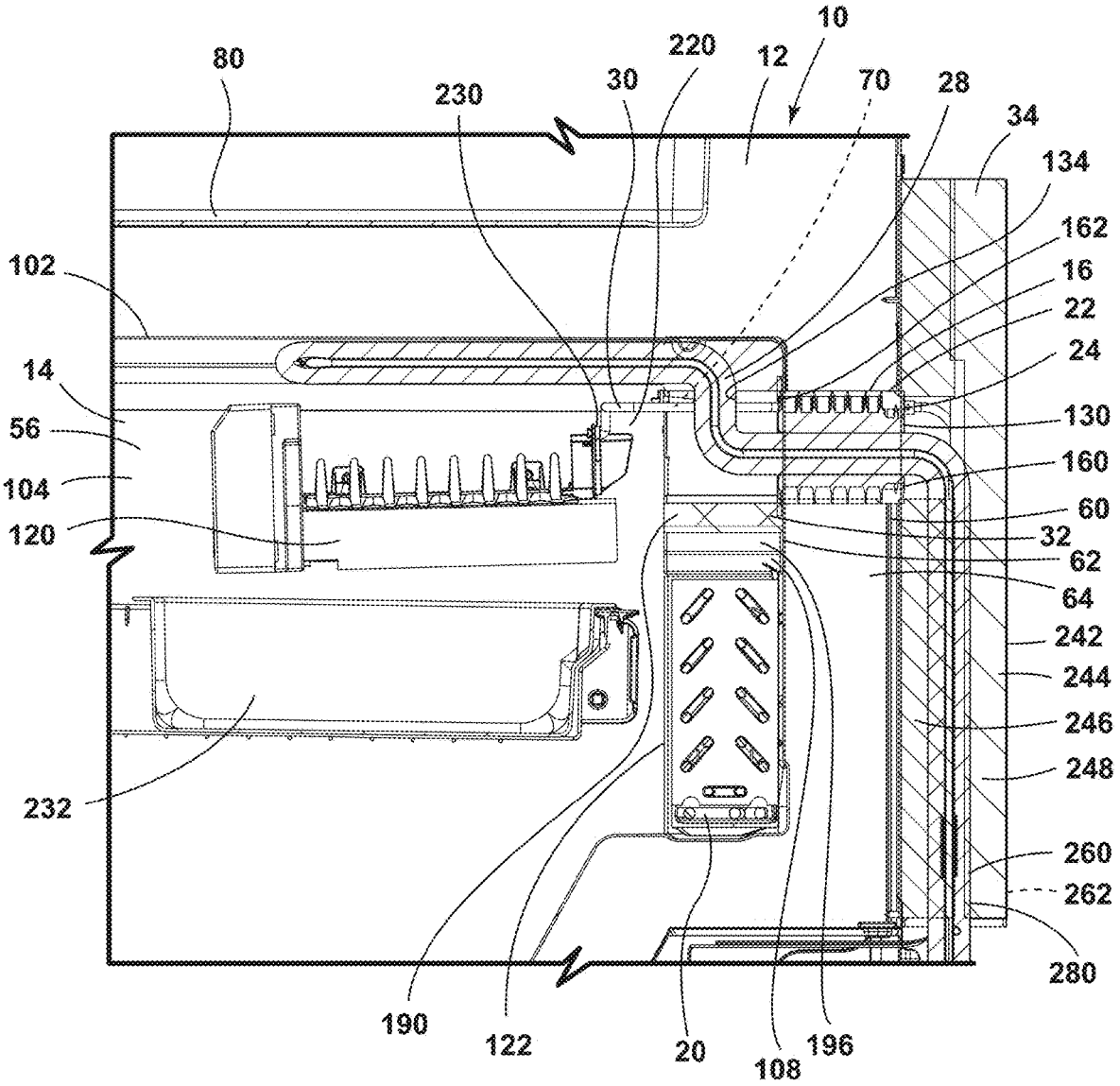
FIG. 10 is a cross-sectional, side elevational view of a freezer compartment of a refrigeration appliance, according to the present disclosure.
Figure 11:
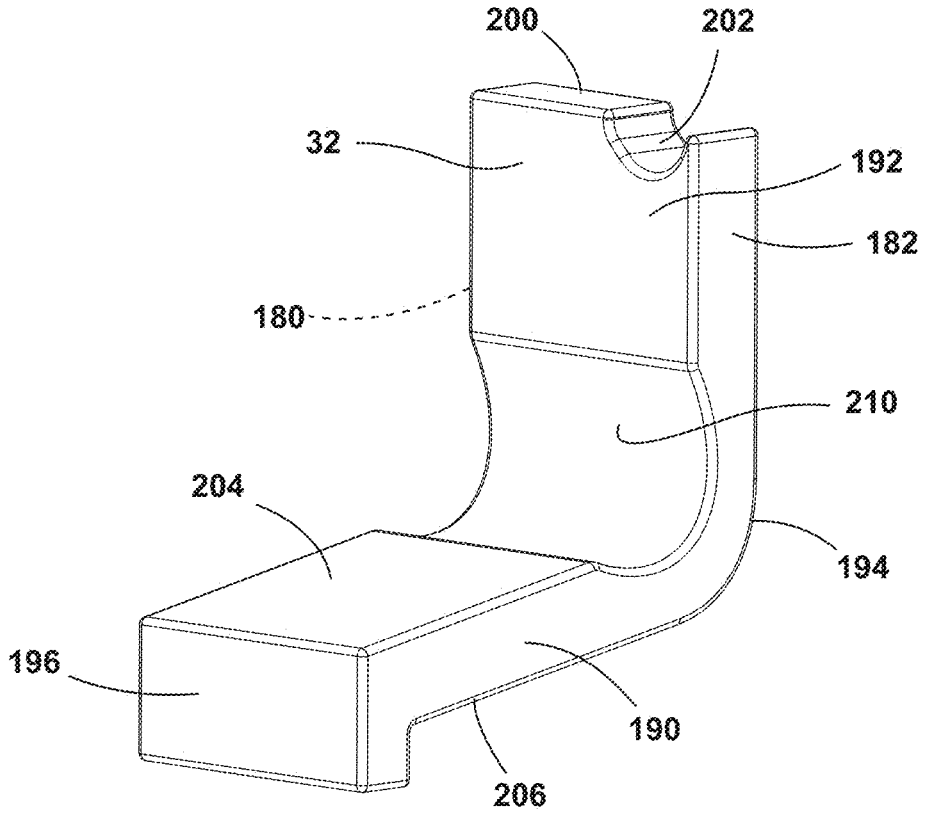
FIG. 11 is a front perspective view of a insulation block of a refrigeration appliance, according to the present disclosure.
Figure 12:
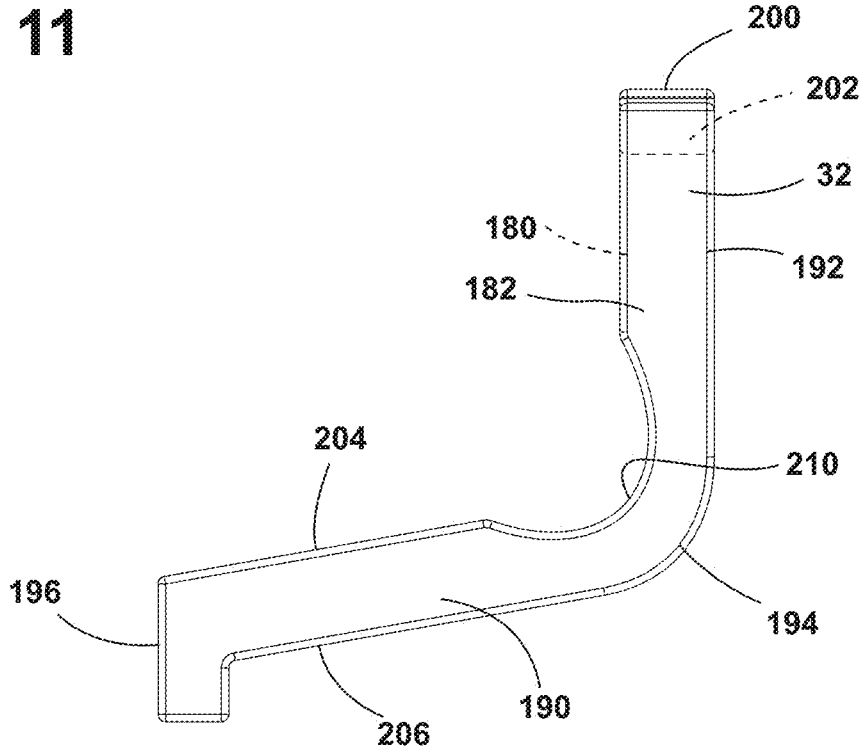
FIG. 12 is a side elevational view of the insulation block of FIG. 11, according to the present disclosure.

The insulation block 32 may be coupled to the ceiling 102 and the first sidewall 84 and/or the second sidewall 106 of the freezer compartment 56 such that an insulated region 220 is defined. As illustrated in FIGS. 9 and 10, the insulated region 220 is defined as the region encompassed by the first portion 190, the second portion 192, the cover panel 122, the first sidewall 104, and the ceiling 102. According to various aspects, the temperature within the insulated region 220 may be greater than the temperature of a region external to the insulated region 220 due to the insulative barrier provided by the first portion 190 and the second portion 192. For example, the temperature within the insulated region 220 may be greater than the temperature of a region surrounding the evaporator 20 due to the first portion 190 and the second portion 192 being made from an insulating foam, such as expanded polystyrene, and due to the first portion 190 and the second portion 192 being disposed between the water line 30 and the evaporator 20. In such examples, the greater temperature of the insulated region 220 reduces or eliminates the possibility of water freezing in the water line 30 due to heat loss.

Referring to FIG. 10, the refrigeration appliance 10 includes the ice-maker 120 disposed within the freezer compartment 56. The ice-maker 120 is disposed inside of the liner 62 of the vacuum-insulated structure 12 and may be accessible via the freezer opening 110. In various aspects, the ice-maker 120 may be disposed downward of the pass-through 16 and/or the insulation block 32. The ice-maker 120 is in liquid communication with the water line 30. In some examples, the water line 30 may extend towards the opening 110 of the freezer compartment 56 and in a downward direction, towards the ice-maker 120. In various aspects, the water line 30 includes an open-end 230 that is coupled to the ice-maker 120 and is in fluid communication with the ice-maker 120. In some examples, the diameter of the water line 30 at the open-end 230 may be greater than the diameter of the water line 30 as it extends into the freezer compartment 56. In such examples, the greater diameter at the open-end 230 may prevent water in the water line 30 from being suction-locked in place, and instead, permit the downward flow of water into the ice-maker 120. In use, water flows through the water line 30 and into the ice-maker 120. The ice-maker 120 then uses the collected water to form ice pieces. The ice pieces may then be disposed in an ice tray 232 disposed in the freezer compartment 56 and downward of the ice-maker 120.

Referring back to FIGS. 5-8, the refrigeration appliance 10 includes the pass-through cover 34 disposed over the pass-through 16 and coupled to the wrapper 60. According to various aspects, the pass-through cover 34 includes a back cover 242 disposed over the pass-through 16. The back cover 242 defines a cavity 244 that receives a first pad 246 and a second pad 248. The cavity 244 may be defined such that a shape and/or size of the cavity 244 coincides with a shape and/or size of the first pad 246 and the second pad 248 and insertion of each pad 246, 248 into the cavity 244 is permitted. The back cover 242 further defines an outer rim 250 that at least partially extends along an outer periphery of the cavity 244. The outer rim 250 couples to the wrapper 60 and compresses a gasket 252, such as a foam or rubber gasket, to define a sealed interface between the back cover 242 and the wrapper 60.

The first pad 246 is disposed within the cavity 244 and extends along the wrapper 60. The first pad 246 is positioned such that an external portion 260 of the refrigerant line 28 and an external section 262 of the water line 30 each extend generally parallel with an outer surface 264 of the first pad 246. The first pad 246 also defines an aperture 270 with a size that coincides with the pass-through 16. For example, the aperture 270 may have a size that coincides with a size of the wrapper aperture 130 and/or the liner aperture 134. The aperture 270 permits extension of the refrigerant line 28 and the water line 30 through the first pad 246 and subsequently through the pass-through 16.

The second pad 248 is disposed within the cavity 244 and abuts the outer surface 264 of the first pad 246. According to various aspects, the second pad 248 may define a shape and/or size that coincides with a shape and/or size of the first pad 246. In some examples, the second pad 248 may define one or more channels 280 that extend along an inner surface 282 of the second pad 248. The channels 280 may receive the external portion 260 of the refrigerant line 28 and the external section 262 of the water line 30 such that the external portion 260 and the external section 262 are recessed into the second pad 248 and the inner surface 282 of the second pad 248 is abutting the outer surface 264 of the first pad 246. Both the first pad 246 and the second pad 248 may be made of various insulating materials, such as expanded polystyrene. According to various aspects, the encompassing of the external portion 260 of the refrigerant line 28 and the external section 262 of the water line 30 and the placement of the first pad 246 and the second pad 248 over the pass-through 16 provides for an insulative layer that mitigates or eliminates external condensation on the pass-through 16 and/or the pass-through grommet 22, while also reducing heat transfer between the refrigerant line 28 and the water line 30, and between the external environment 18 and the refrigerant line 28 and the water line 30.

Figure 13:
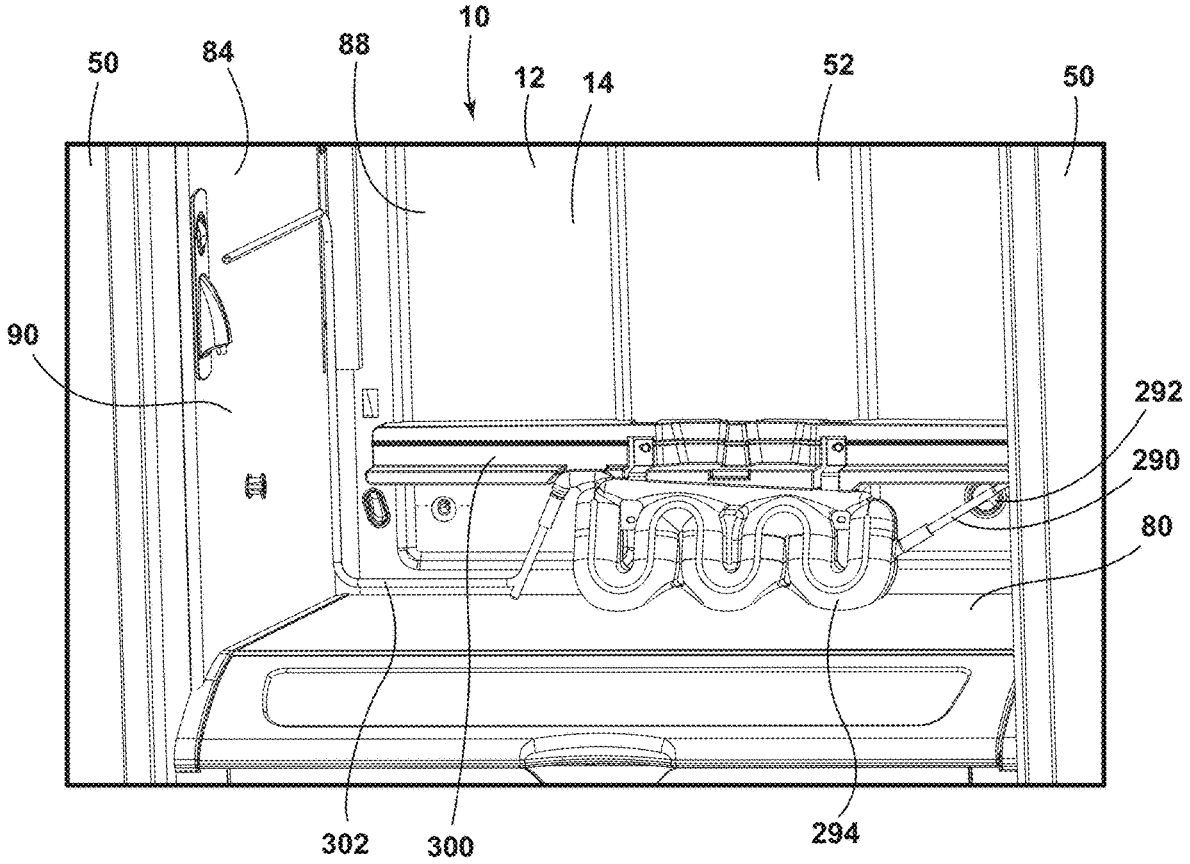
FIG. 13 a front perspective view of a refrigerator compartment with a water tank, according to the present disclosure.

Referring to FIG. 13, an inlet water line 290 extends from the external environment 18 and into the refrigerator compartment 52 via a refrigerator pass-through 292 that is defined on the vacuum-insulated structure 12 and permits extension of the inlet water line 290 into the refrigerator compartment 52. The inlet water line 290 then extends towards and couples to a water tank 294. In use, the inlet water line 290 carries water from an external source, through the refrigerator pass-through 292, and into the water tank 294.

Referring further to FIG. 13, the water tank 294 is disposed within the interior compartment 14, such as the refrigerator compartment 52. In various aspects, the water tank 294 is disposed adjacent the rear wall 88 and floor 80 of the refrigerator compartment 52. For example, the water tank 294 may be coupled to a bracket 300 that extends along the rear wall 88. In some examples, the water tank 294 defines a sinuous, S-shape, that permits the flow of all water in the water tank 294. The water tank 294 receives water from the inlet water line 290, which is coupled to the water tank 294. The water tank 294 outputs water to an outlet water line 302 that extends from the water tank 294 and towards one or more water dispensers.

Referring to FIGS. 1-13, the present disclosure provides for a variety of advantages. For example, extending both the refrigerant line 28 and the water line 30 through the pass-through 16 limits the number of apertures through the vacuum-insulated structure 12 that need to be made in order for the refrigerant line 28 and the water line 30 to extend into the freezer compartment 56. Similarly, the single pass-through 16 into the freezer compartment 56 increases the ability of the vacuum-insulated structure 12 to maintain a vacuum within the vacuum-insulated cavity 64. Further, the spaced apart relationship of the refrigerant line 28 and the water line 30 as each line 28, 30 extends through the pass-through 16, as well as the placement of the insulation block 32 between the water line 30 and the evaporator 20 and the use of the heater 70 all assist in reducing heat loss and preventing freezing of the water within the water line 30.

This device disclosed herein is further summarized in the following paragraphs and is further characterized by combinations of any and all of the various aspects, described herein.

According to one aspect of the present disclosure, a refrigeration appliance includes a vacuum-insulated structure that defines an interior compartment. The vacuum-insulated structure defines a pass-through through the vacuum-insulated structure that provides access from an external environment to the interior compartment. An evaporator is disposed within the interior compartment. The evaporator is operable to lower or maintain a temperature of the interior compartment below ambient temperature. A pass-through grommet is disposed within the pass-through. The pass-through grommet defines a first aperture and a second aperture. A refrigerant line extends through the first aperture and into the interior compartment. The refrigerant line is in fluid communication with the evaporator. A water line extends through the second aperture and into the interior compartment. An insulation block is disposed within the interior compartment. The insulation block is disposed between the evaporator and the water line. A pass-through cover is disposed over the pass-through and is coupled to the vacuum-insulated structure.

According to another aspect, an insulation block extends from a sidewall of an interior compartment and to a ceiling of the interior compartment.

According to another aspect of the present disclosure, an insulation block abuts a pass-through grommet.

According to another aspect, an insulation block defines an insulation block channel, and a refrigerant line and water line extend along the insulation block channel.

According to another aspect, an insulation block channel defines a semi-circular shape that coincides with a circular shape of the pass-through.

According to another aspect, a heater is disposed proximate an insulation block.

According to another aspect of the present disclosure, a vacuum-insulated structure defines an interior compartment. The vacuum-insulated structure defines a pass-through extending through the vacuum-insulated structure and providing access from an external environment to the interior compartment. An evaporator is disposed within the interior compartment. The evaporator is operable to lower or maintain a temperature of the interior compartment below ambient temperature. A refrigerant line extends through the pass-through and into the interior compartment. The refrigerant line is in fluid-communication with the evaporator. A water line extends through the pass-through and into the interior compartment. An insulation block is disposed within the interior compartment and between the evaporator and water line. The insulation block at least partially encircles the water line.

According to another aspect, a pass-through grommet is disposed within the pass-through.

According to another aspect, a pass-through grommet defines a first aperture and a second aperture extending through the pass-through grommet, and the refrigerant line extends through the first aperture and the water line extends through the second aperture.

According to another aspect, a first portion, a second portion, a sidewall, and a ceiling at least partially define an insulated region around a water line.

According to another aspect, a pass-through cover is coupled to a vacuum-insulated structure and disposed over a pass-through.

According to another aspect of the present disclosure, a refrigeration appliance includes a vacuum-insulated structure that defines an interior compartment. The vacuum-insulated structure defines a pass-through through the vacuum-insulated structure. The pass-through provides access from an external environment to the interior compartment. An evaporator is disposed within the interior compartment. The evaporator is operable to lower or maintain a temperature of the interior compartment below ambient temperature. A refrigerant line extends through the pass-through and into the interior compartment. A water line extends through the pass-through and into the interior compartment. An insulation block is disposed within the interior compartment and between the evaporator and the water line.

According to another aspect, a pass-through grommet is disposed in a pass-through, and the pass-through grommet defines a first aperture and a second aperture, and a refrigerant line extends through the first aperture and a water line extends through the second aperture.

According to another aspect, an insulation block abuts a pass-through grommet.

According to another aspect, an insulation block includes a first portion that extends towards a sidewall of an interior compartment and a second portion that extends towards a ceiling of the interior compartment.

According to another aspect, a first portion of an insulation block includes an abutment section coupled to a sidewall, and the abutment section extends downward from the first portion, and a second portion includes a top surface coupled to a ceiling.

According to another aspect, a first portion is obliquely orientated relative to a second portion.

According to another aspect, a pass-through cover is coupled to a vacuum-insulated structure and is disposed over a pass-through. A heater is disposed proximate an insulation block and a water line.

According to another aspect, an insulation block at least partially encircles a water line.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration appliance, comprising:

a vacuum-insulated structure defining an interior compartment, the vacuum-insulated structure defining a pass-through therethrough providing access from an external environment to the interior compartment;

an evaporator disposed within the interior compartment, the evaporator being operable to lower or maintain a temperature of the interior compartment below ambient temperature;

a pass-through grommet disposed within the pass-through, the pass-through grommet defining a first aperture and a second aperture;

a refrigerant line that extends through the first aperture and into the interior compartment, the refrigerant line in fluid communication with the evaporator;

a water line extending through the second aperture and into the interior compartment;

an insulation block disposed within the interior compartment, the insulation block being disposed between the evaporator and the water line, wherein the insulation block abuts the pass-through grommet; and a pass-through cover disposed over the pass-through and coupled to the vacuum-insulated structure.

2. The refrigeration appliance of claim 1, wherein the insulation block extends from a sidewall of the interior compartment to a ceiling of the interior compartment.

3. The refrigeration appliance of claim 1, wherein the insulation block defines an insulation block channel, and wherein the refrigerant line and the water line extend along the insulation block channel.

4. The refrigeration appliance of claim 3, wherein the insulation block channel defines a semi-circular shape that coincides with a circular shape of the pass-through.

5. The refrigeration appliance of claim 1, further comprising:

a heater disposed proximate the insulation block.

6. A refrigeration appliance, comprising:

a vacuum-insulated structure defining an interior compartment, the vacuum-insulated structure defining a pass-through therethrough providing access from an external environment to the interior compartment;

an evaporator disposed within the interior compartment, the evaporator being operable to lower or maintain a temperature of the interior compartment below ambient temperature;

a refrigerant line that extends through the pass-through and into the interior compartment, the refrigerant line in fluid communication with the evaporator;

a water line extending through the pass-through and into the interior compartment; and an insulation block disposed within the interior compartment and between the evaporator and the water line, wherein the insulation block at least partially encircles the water line, and wherein the insulation block includes a first portion extending toward a sidewall of the interior compartment and a second portion extending toward a ceiling of the interior compartment.

7. The refrigeration appliance of claim 6, further comprising:

a pass-through grommet disposed within the pass-through.

8. The refrigeration appliance of claim 7, wherein the pass-through grommet defines a first aperture and a second aperture extending through the pass-through grommet, and wherein the refrigerant line extends through the first aperture and the water line extends through the second aperture.

9. The refrigeration appliance of claim 6, wherein the first portion, the second portion, the sidewall, and the ceiling at least partially define an insulated region around the water line.

10. The refrigeration appliance of claim 6, further comprising:

a pass-through cover coupled to the vacuum-insulated structure and disposed over the pass-through.

11. A refrigeration appliance, comprising:

a vacuum-insulated structure defining an interior compartment, the vacuum-insulated structure defining a pass-through therethrough providing access from an external environment to the interior compartment;

an evaporator disposed within the interior compartment, the evaporator being operable to lower or maintain a temperature of the interior compartment below ambient temperature;

a refrigerant line that extends through the pass-through and into the interior compartment;

a water line extending through the pass-through and into the interior compartment; and an insulation block disposed within the interior compartment and between the evaporator and the water line, wherein the insulation block includes a first portion that extends toward a sidewall of the interior compartment and a second portion that extends toward a ceiling of the interior compartment.

12. The refrigeration appliance of claim 11, further comprising:

a pass-through grommet disposed in the pass-through, the pass-through grommet defining a first aperture and a second aperture, wherein the refrigerant line extends through the first aperture and the water line extends through the second aperture.

13. The refrigeration appliance of claim 12, wherein the insulation block abuts the pass-through grommet.

14. The refrigeration appliance of claim 11, wherein the first portion includes an abutment section coupled to the sidewall, and wherein the abutment section extends downward from the first portion, and wherein the second portion includes a top surface coupled to the ceiling.

15. The refrigeration appliance of claim 11, wherein the first portion is obliquely orientated relative to the second portion.

16. The refrigeration appliance of claim 11, further comprising:

a pass-through cover coupled to the vacuum-insulated structure and disposed over the pass-through; and a heater disposed proximate the insulation block and proximate the water line.

17. The refrigeration appliance of claim 11, wherein the insulation block at least partially encircles the water line.

* * * * *